US010645977B2

(12) United States Patent
Gu

(10) Patent No.: US 10,645,977 B2
(45) Date of Patent: May 12, 2020

(54) UNDERGARMENT WITH ADJUSTABLE FEATURES

(71) Applicant: Hai Gu, Novi, MI (US)

(72) Inventor: Hai Gu, Novi, MI (US)

( * ) Notice: Subject to any disclaimer, the term of this patent is extended or adjusted under 35 U.S.C. 154(b) by 0 days.

(21) Appl. No.: 16/155,414

(22) Filed: Oct. 9, 2018

(65) Prior Publication Data

US 2019/0110523 A1 Apr. 18, 2019

Related U.S. Application Data

(60) Provisional application No. 62/572,135, filed on Oct. 13, 2017.

(51) Int. Cl.
*A41B 9/02* (2006.01)

(52) U.S. Cl.
CPC ..... *A41B 9/023* (2013.01); *A41B 9/026* (2013.01)

(58) Field of Classification Search
CPC ..... A41B 9/023
USPC ..... 2/403
See application file for complete search history.

(56) References Cited

U.S. PATENT DOCUMENTS

| | | | | |
|---|---|---|---|---|
| 5,920,914 | A * | 7/1999 | Dempsey | A41B 9/02 2/400 |
| 8,726,423 | B2 * | 5/2014 | Gu | A41B 9/023 2/404 |
| 8,782,817 | B2 | 7/2014 | Gu | |
| 2013/0104293 | A1 * | 5/2013 | Gu | A41B 9/023 2/404 |
| 2013/0219591 | A1 * | 8/2013 | Gu | A41B 9/023 2/405 |
| 2017/0135875 | A1 * | 5/2017 | Johnson | A41B 9/02 |
| 2019/0110523 | A1 * | 4/2019 | Gu | A41B 9/023 |
| 2019/0208830 | A1 * | 7/2019 | Yoo | A41B 9/023 |

* cited by examiner

*Primary Examiner* — Gloria M Hale
(74) *Attorney, Agent, or Firm* — Dinsmore & Shohl LLP

(57) ABSTRACT

An undergarment for a man has a pair of boxer type shorts with a waistband forming part of the shorts. The shorts have a genital partitioning panel with an upper edge and an opposed lower edge separated by a panel height. The genital partitioning panel has a genital opening defined therethrough and the opening is positioned such that the genitals may be positioned through the opening and the genital partitioning panel defines a partition between the genitals and the legs or groin of the man. The shorts also have a plurality of attachment elements to selectively adjust a distance between the genital opening and the waistband.

20 Claims, 6 Drawing Sheets

UNDERGARMENT WITH ADJUSTABLE FEATURES

CROSS-REFERENCE TO RELATED APPLICATIONS

This application claims priority from Provisional Application No. 62/572,135 filed Oct. 13, 2017, the entire content of which is incorporated herein by reference.

Applicant's Related Applications also include Ser. No. 13/796,501, now U.S. Pat. No. 8,782,817 and application Ser. No. 13/662,911, now U.S. Pat. No. 8,726,423.

FIELD OF THE INVENTION

The present invention relates generally to undergarments for men.

BACKGROUND OF THE INVENTION

Traditional undergarments and pajamas for men come in multiple varieties. Variants of these undergarments generally have a different waist size and shape (e.g. briefs, trunks, boxers, boxer briefs), etc. In these undergarments, the position of a genital opening is generally fixed and may not fit the man's physique or preference. If a man wears an undergarment according to waist size and/or shape of his choice, his genitals may not align with the genital opening. This limits the range of his choice and is also inconvenient for the wearer. Undergarments and pajamas for covering the groin and genital area include briefs, which are relatively form fitting and hold the genitals against the body, and boxers that are looser. Briefs provide some genital support, but also limit the circulation of air around the genitals. Neither boxers nor briefs seek to fit material between the genitals and the groin and/or legs of the wearer. There remains a need for improved undergarments and pajamas that provide an adjustable separation and free fit between the genitals and the groin and/or legs of the wearer.

SUMMARY OF THE INVENTION

An embodiment of an undergarment for a man has a pair of boxer type shorts with a waistband forming part of the shorts. The waistband has a front part that is disposed on the front of the waist of a man. The boxer type short also has a pants portion interconnected with the waistband and extends downwardly therefrom. The pants portion defines a pair of leg openings and a crotch region therebetween.

The pants portion has a front section that is disposed on the front of the torso and legs of the man wearing the shorts, and an opposed rear section that is disposed on the buttocks and rear of the legs of the man wearing the shorts. The front and rear sections are interconneted by the crotch region and a pair of opposed side sections. The front section has an inner surface and an opposing outer surface. The inner surface is disposed generally towards the front of the torso and legs of the man wearing the shorts.

The underwear also has a genital partitioning panel with an upper edge and an opposed lower edge separated by a panel height. The genital partitioning panel further has a pair of side edges extending between the upper and lower edges. The pair of side edges is separated by a panel width and the genital partitioning panel is interconnected with the shorts at the upper edge of the genital partitioning panel. The genital partitioning panel has a genital opening defined therethrough. The opening is positioned such that when the waistband is disposed on the waist of a man, the genitals may be positioned through the opening and the genital partitioning panel defines a partition between the genitals and the legs or groin of the man.

The underwear may also have a plurality of vertically spaced apart attachment elements disposed on the genital partitioning panel near the side edges toward the upper edge and at least two attachment elements disposed horizontally spaced apart on the inner surface of the shorts towards the waistband. The at least two attachment elements on the shorts and the corresponding attachment elements of both side edges on the genital partitioning panel secure the genital partitioning panel to the inner surface of the shorts to selectively adjust a distance between the genital opening and the waistband.

In some embodiments, the underwear may have at least two attachment elements. One of the at least two attachment elements may be disposed near each side edge towards the upper edge on the genital partitioning panel and a plurality of vertically spaced apart attachment elements may be disposed on the inner surface of the shorts towards the waistband for the corresponding at least two attachment elements disposed near each side edge. The at least two attachment elements disposed near each side edge and the corresponding attachment elements disposed on the shorts secure the genital partitioning panel to the inner surface of the shorts to selectively adjust the distance between the genital opening and the waistband.

According to another embodiment of the undergarment, the upper edge of the genital partitioning panel may be fixedly connected to the waistband/shorts. The attachment elements may be selected from the group consisting of adjustable straps, hooks, buttons, loop, snaps and zipper. A person skilled in the art may use any suitable attachment element to enable a wearer to interconnect the genital partitioning panel with the inner surface of the shorts at an adjustable distance between the genital opening and the waistband. In some embodiments, the lower edge of the genital partitioning panel is fixedly connected to the shorts. The genital partitioning panel may be interconnected with the boxer type shorts only at limited areas of the lower edge. In other embodiments, the whole lower edge may be interconnected with the boxer type shorts. The panel may generally freely hang downwardly from the upper edge of the panel and the panel may not extend past the crotch region or to the rear section of the pants portion. The genital partitioning panel may be removably interconnected with the boxer type shorts only at limited areas of the lower edge with straps, hooks, buttons, loops, snaps or zipper.

According to some embodiments, the genital partitioning panel may have a U-shaped loop towards the lower edge that is used for adjusting the distance between the genital opening and the waistband. The genital partitioning panel may be fixedly interconnected with the boxer type shorts at the lower edge. In some undergarments, the upper edge and the lower edge is separated by the panel height of 1 inch to 20 inches. In other undergarments, the pair of side edges may be separated by the panel width of 1 inch to 20 inches. The attachment elements may allow adjusting the distance of 1 inch to 12 inches between the genital opening and the waistband. In some embodiments, the distance between the genital opening and the waistband is adjusted in increments of ½ inch, 1 inch, 1½ inches or 2 inches. The undergarment may further have a zipper interconnecting the upper edge of the genital partitioning panel with the shorts. The zipper has a portion of a zipper on the upper edge of the genital partitioning panel and a corresponding portion of a zipper on the shorts, wherein the zipper portions extend along all of the upper edge. In addition to the zipper for the upper edge, the undergarment may also have the attachment elements (e.g. multiple straps, hooks, buttons, loops, snaps or zippers) for adjusting the distance between the genital opening and the waistband.

In some embodiments, the plurality of vertically spaced apart attachment elements are button holes disposed on the genital partitioning panel near the side edges and the at least two attachment elements are buttons disposed horizontally spaced apart on the inner surface. Alternatively, the at least two attachment elements are buttons disposed near each side edge towards the upper edge on the genital partitioning panel and the plurality of vertically spaced apart attachment elements are button holes disposed on the inner surface of the shorts.

The attachment elements may be selected from the group consisting of hook-and-eye type fastener and snap-type buttons. The snap-type buttons consist of studs and sockets. In some embodiments, the plurality of vertically spaced apart attachment elements are hooks/studs disposed on the genital partitioning panel near the side edges and the at least two attachment elements are eyes/sockets disposed horizontally spaced apart on the inner surface. Alternatively, the at least two attachment elements are eyes/sockets disposed near each side edge towards the upper edge on the genital partitioning panel and the plurality of vertically spaced apart attachment elements are hooks/studs disposed on the inner surface of the shorts.

In some undergarments, the downwardly extending pants portion is a brief-style pants portion or a tight-boxer-style pants portion. In other undergarments, the genital opening has a bottom end that is U-shaped or V-shaped. The genital opening may generally be heart shaped. Some embodiments of the undergarment may further have an additional panel that covers the genital partitioning panel to cover the genitals positioned through the genital opening. The additional panel and/or the genital partitioning panel may generally be rectangular shaped.

BRIEF DESCRIPTION OF DRAWINGS

The accompanying drawings, which are included to provide a further understanding of the invention and are incorporated in and constitute a part of this application, illustrate embodiment (s) of the invention and together with the description serve to explain the principle of the invention. In the drawings.

DETAILED DESCRIPTION OF THE INVENTION

The present invention provides several embodiments of an undergarment for a man. These undergarments include a genital partitioning panel with a genital opening defined there through. When the undergarment is worn, the genitals may be positioned through the opening and the genital partitioning panel defines a partition between the genitals and the groin or legs of the man.

Figure 1A:
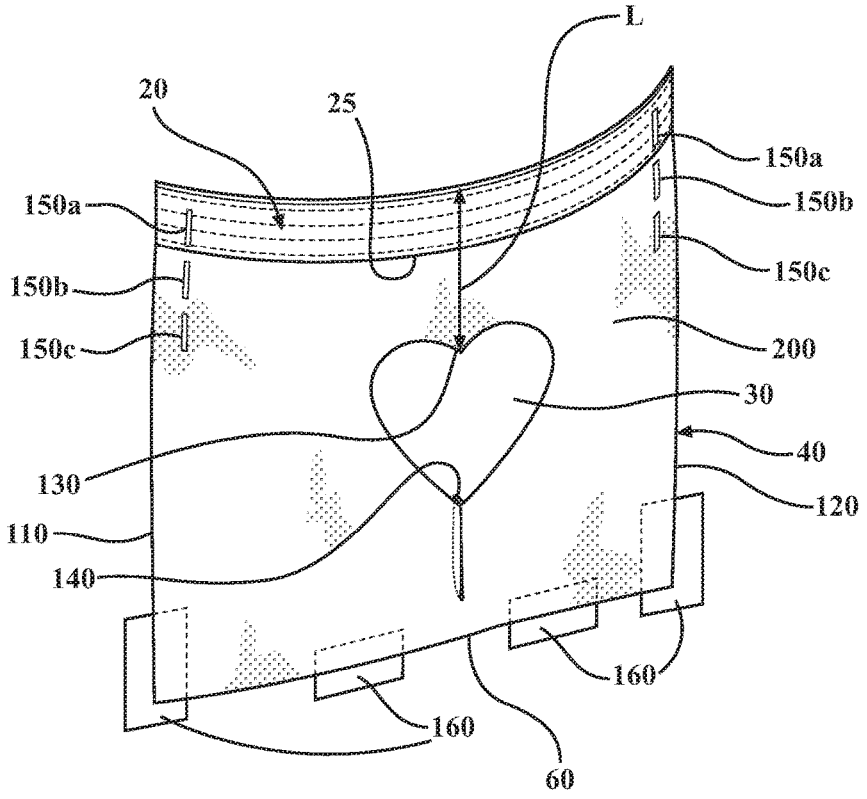
FIG. 1*a* is a perspective view of a genital partitioning panel with a waistband of an embodiment.

Referring to FIG. 1*a*, a portion of a first embodiment of an improved undergarment is shown. The undergarment has a genital partitioning panel 40 formed of a fabric material. The genital partitioning panel 40 has an outer surface 200 and an opposing inner surface (not shown). The genital partitioning panel 40 has an upper edge 25 and a lower edge 60 spaced downwardly from a waistband 20. The upper edge 25 is interconnected with a front part of the waistband 20. The two side edges 110 and 120 extend between the upper edge 25 and the lower edge 60. While in the illustrated embodiment the panel 40 is generally rectangular, it may have other shapes. The panel 40 has a genital opening 30 defined there through. The genital opening 30 is sized and positioned such that the genitals of a wearer may extend through the genital opening 30 such that the remainder of the genital partitioning panel 40 then separates the genitals from the legs of the wearer. The genital opening 30 has an upper end 130 disposed generally towards the upper edge 25 and a lower end 140 that is disposed generally towards the lower edge 60.

The genital partitioning panel 40 has a distance "L" between the upper end 130 and the upper edge 25. The upper edge 25 may be detachably attached to the waistband 20 with a plurality of attachment elements (e.g. zipper, hook, loop, snaps, buttons or other means) such that "L" may be adjusted i.e. increased/decreased. Different wearers may prefer different genital-to-waist length because of the using habit or height of different people. This may be accomplished by varying "L" using the attachment elements (150*a*, 150*b*, 150*c*) such as an adjustable zipper, hook, loop, snaps, buttons, Velcro (also known as hook-and-loop fasteners) or other means. These attachment elements or other suitable attachment elements may also be used with any embodiment according to this invention. In one example, the distance "L" may be adjustable from 1 inch to 12 inches. In other examples, the range of distance "L" may be different depending on the targeted user demography. The distance "L" may be adjusted in increments of ½ inch, 1 inch, 1½ inch, or 2 inches. Other increment values may be chosen depending on wearer preferences or wearer's market segment requirements.

Figure 1B:
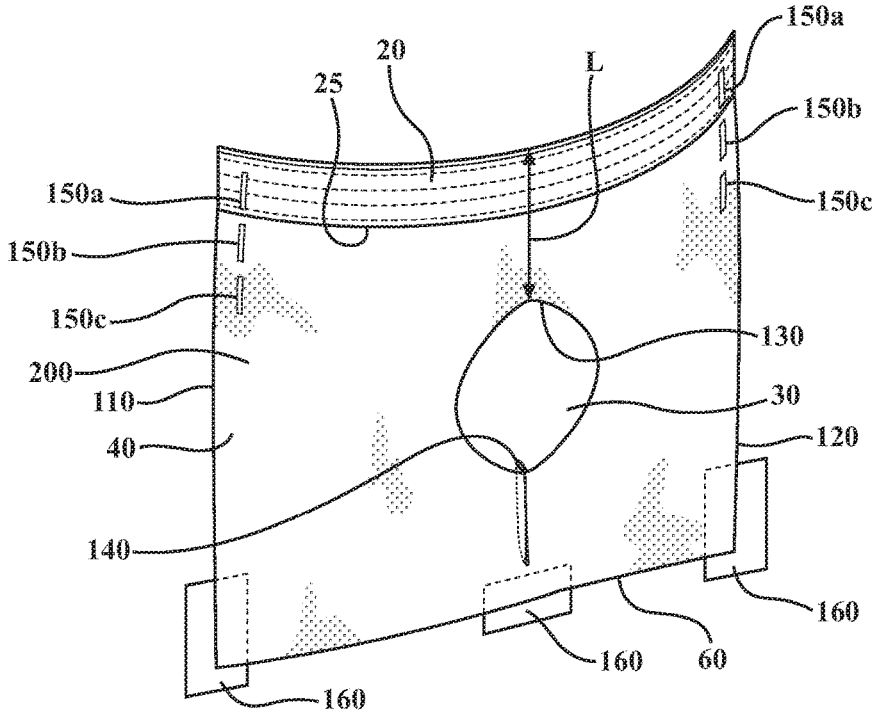
FIG. 1*b* is a perspective view of a genital partitioning panel with a waistband of another embodiment.

FIG. 1*b* shows a portion of another embodiment of an improved undergarment. As shown in FIGS. 1*a* and 1*b*, an undergarment may use the attachment elements (150*a*, 150*b*, 150*c*) such as buttons in combination with button holes for adjusting "L" in 3 increments of 1 inch each. In other embodiments, the undergarment may be adjusted in a range of two to ten increments. The genital partitioning panel 40 may have 3 buttonholes i.e. 150*a*, 150*b*, 150*c* each along the side edges 110 and 120 toward the upper edge 25 at a distance of 1 inch each. One button each (not shown) may be sewn on the waistband 20 around the intersection between the upper edge 25 with the respective side edges 110 and 120. If distance "L" is to be decreased by 1 inch, then the buttons (not shown) on both edges are detached from buttonhole 150*a* on both edges and are attached with buttonhole 150*b* on the respective both edges. In other embodiments, the waistband 20 may have a button hole and the genital partitioning panel 40 may have three vertically positioned buttons on the side edges 110 and 120 toward the upper edge 25. Distance "L" may similarly be increased. In other embodiments, where other above-mentioned attachment elements/fastening means e.g. hooks, zipper etc. are used, distance "L" may be increased or decreased using the same above-discussed concept.

The dimensions of the undergarment will vary depending on the size of the wearer and how the undergarment is worn. In one example, the genital partitioning panel 40 has a height from the upper edge 25 to the lower edge 60 of approximately 12 inches, and a side-to-side width between the side edges 110 and 120 of approximately 12 inches. In this example, the genital opening 30 has a height of approximately 3 inches, a width of approximately 3 inches, and is generally rectangular with a rounded lower edge. The genital opening 30 may have other shapes, such as U-shaped with the genital opening extending part way or all the way to the waistband, or square or round or oval or heart shaped or any other shape. These alternative shapes apply to all embodiments discussed herein. In this example, the upper end 130 of the opening 30 is spaced from the upper edge 25 of the genital partitioning panel 40 by a distance of approximately 3 inches. In further examples, the genital partitioning panel 40 has a height from the upper edge 25 to the lower edge 60 in the range of 1 inch to 20 inches, and a side-to-side width between the side edges 110 and 120 in the range of 1 inch to 20 inches. The genital opening 30 may have a height in the range of 0.5 inch to 10 inches and a width in the range of 0.5 inch to 10 inches.

Figure 2:
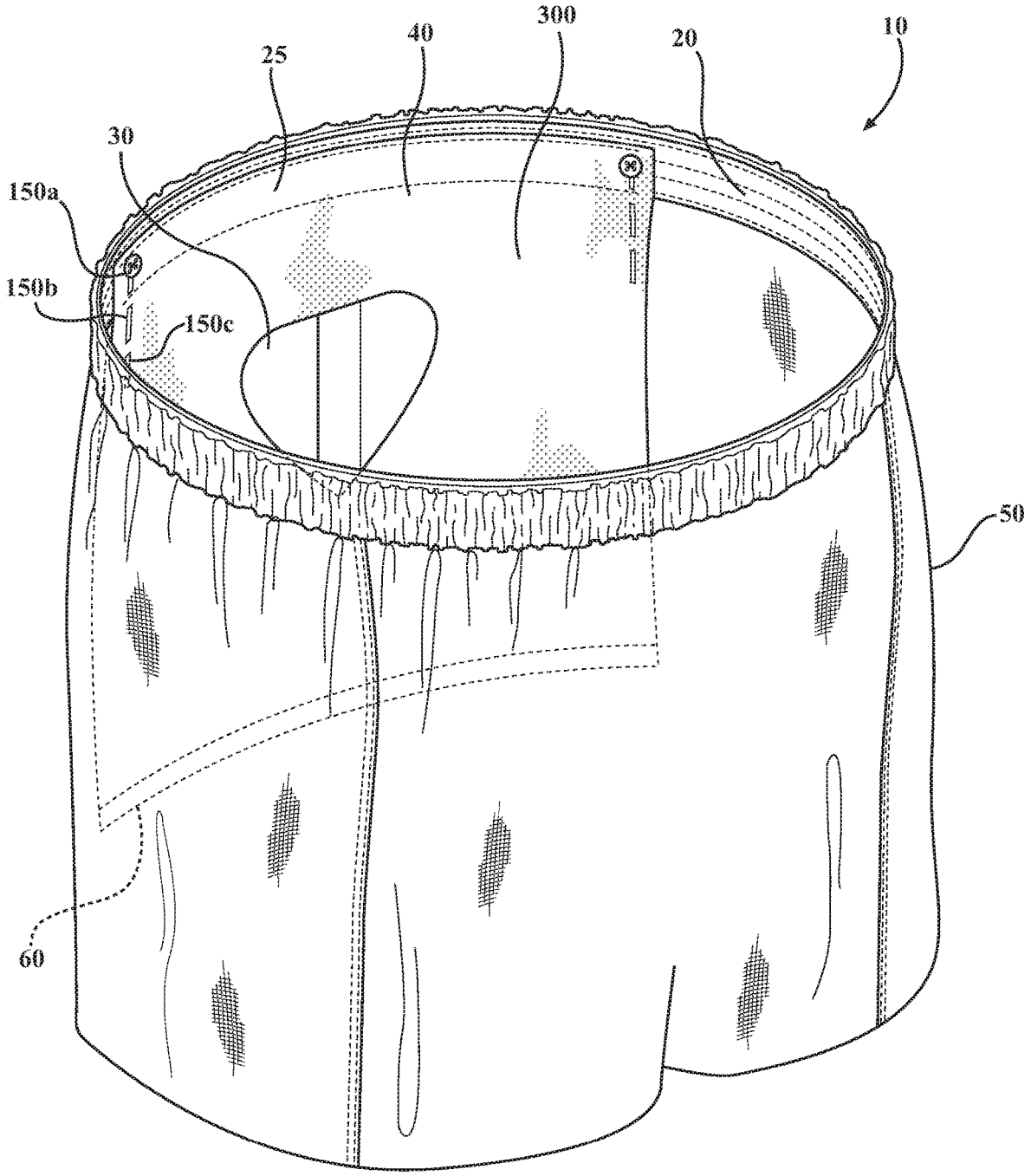
FIG. 2 is a perspective view of an embodiment of an undergarment.

The genital opening 30 may have other shapes. As shown in FIG. 1*b*, the genital opening 30 has a generally circular shape. The upper end 130 of the genital opening 30 may be spaced from the upper edge 25 of the panel 40 by the distance "L" in the range of 1 inch to 11 inches. The genital partitioning panel is preferably made of a soft and absorbent material, such as cotton, though other materials may be used. FIG. 2 is a rear perspective view of the genital partitioning panel 40 of FIG. 1*a*. FIG. 2 shows the inner surface 300 of the front section that contacts the wearer's body. In this embodiment, the genital partitioning panel 40 may be completely detached from the undergarment 10 and upper edge 25 may be removably attached to waistband 20 whenever a wearer desires to use the genital partitioning panel 40. Lower edge 60 may be fixedly attached with the undergarment 10 or may not be attached, i.e. free hanging. In some embodiments, lower edge 60 may also be removably attached with the undergarment 10 in a manner similar to upper edge 25 (as discussed above). As shown in FIGS. 1*a* and 1*b*, the lower edge 60 may be removably attached with the undergarment using one or more attachment elements 160. In other embodiments, the lower edge 60 in FIGS. 1*a* and 1*b* may not be attached and be free hanging.

Figure 3:
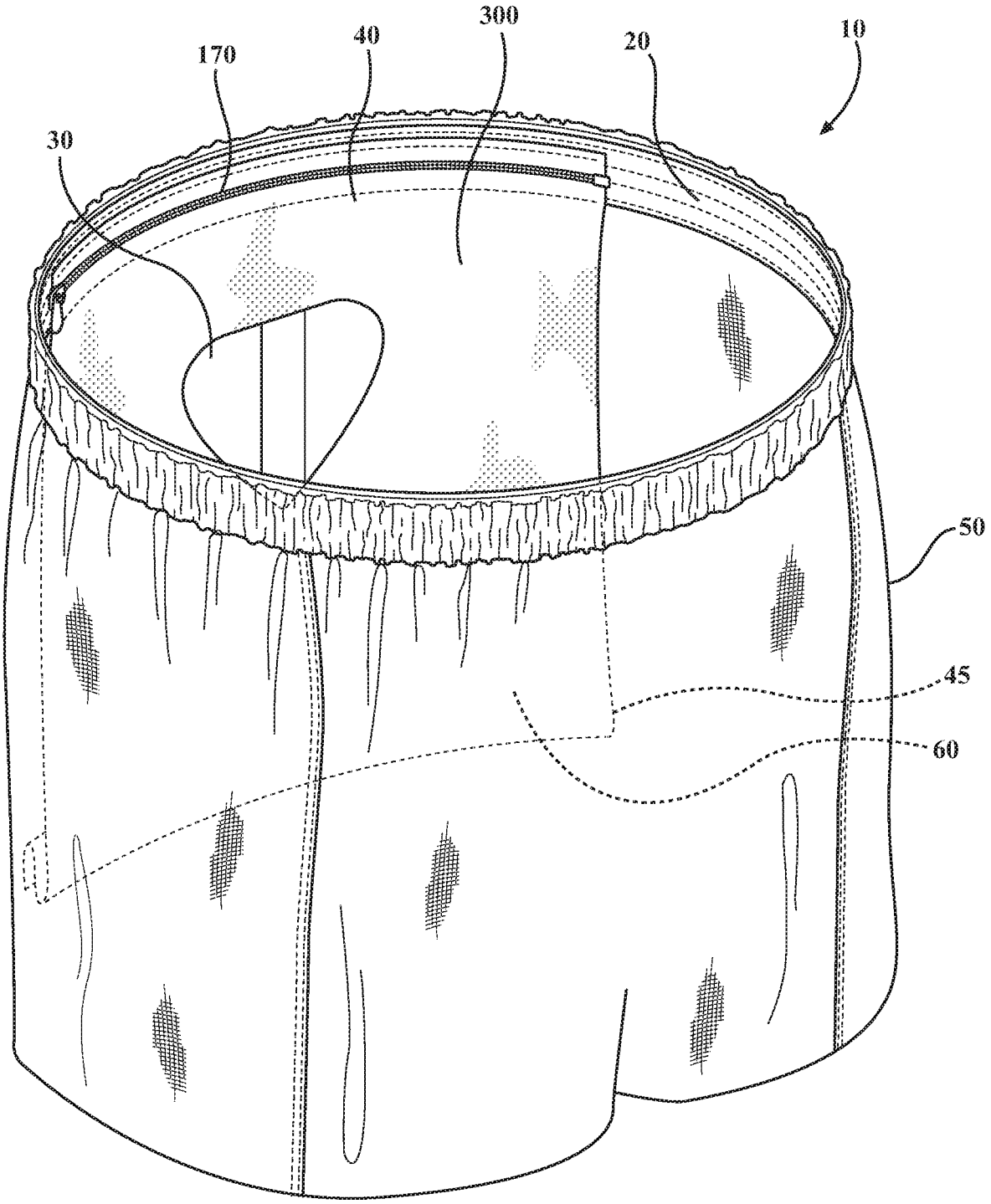
FIG. 3 is a perspective view of another embodiment of an undergarment.
Figure 6:
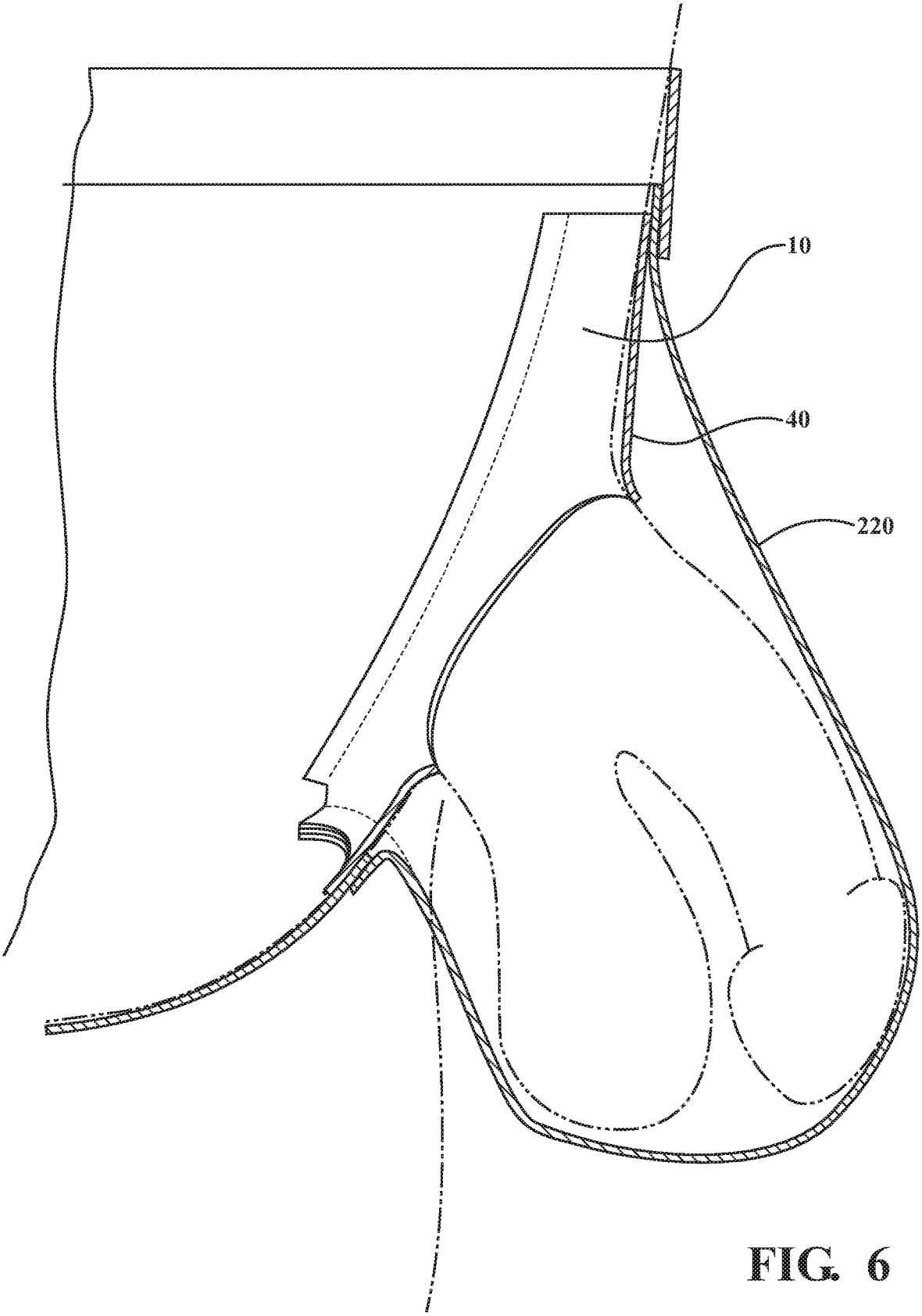
FIG. 6 is a perspective view of an embodiment of an undergarment with an additional panel.

Referring now to FIG. 3, another embodiment of an undergarment 10 has a waistband 20 supporting a genital partitioning panel 40. A wearer positions the waistband 20 of the brief/short/boxer 50 around their waist and positions their genitals through the genital opening 30. In other versions, as shown in FIG. 6, the undergarment 10 may have an additional panel 220 covering the genital partitioning panel 40 to cover the front of the genitals. The additional panel 220 may have a different size and/or shape. As will be clear to those of skill in the art, the opening 30 may provide some support and mainly separation for the genitals from the legs of the wearer.

In FIG. 3, the lower edge 60 of the genital partitioning panel 40 is fixedly attached with the brief/short/boxer 50. The lower edge 60 of the genital partitioning panel 40 may be sewn to the brief/short/boxer 50. However, the upper edge 25 is removably attached to waistband 20 using a zipper 170. The upper edge 25 may be removably attached using adjustable straps, hooks, buttons, loops, snaps, or other means. The genital partitioning panel 40 may have a U-shaped overlap 45 that is used for a vertical adjustment of distance "L" from 1-10 inches or any other suitable range depending on wearer's habit or physical dimensions. Other embodiments of the undergarment according to this disclosure with the attached lower edge may also have the U-shaped overlap shown in FIG. 3.

Figure 4A:
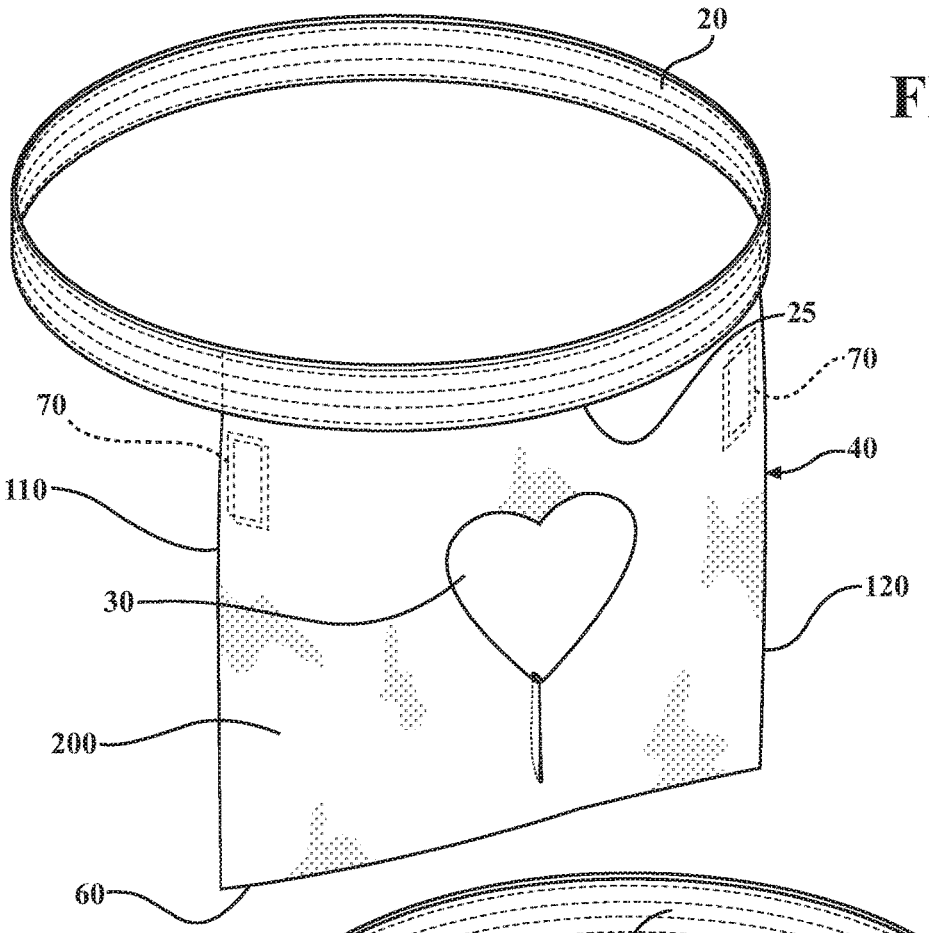
FIG. 4*a* is a perspective view of a genital partitioning panel with a waistband of an embodiment.
Figure 4B:
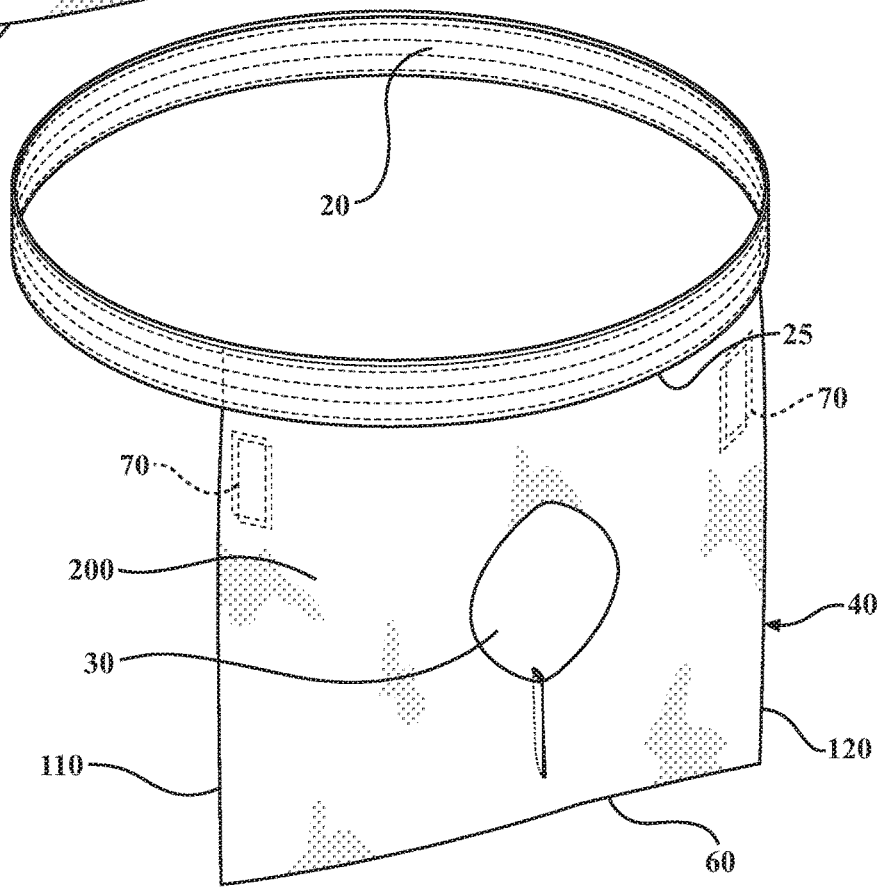
FIG. 4*b* is a perspective view of a genital partitioning panel with a waistband of an embodiment.
Figure 5:
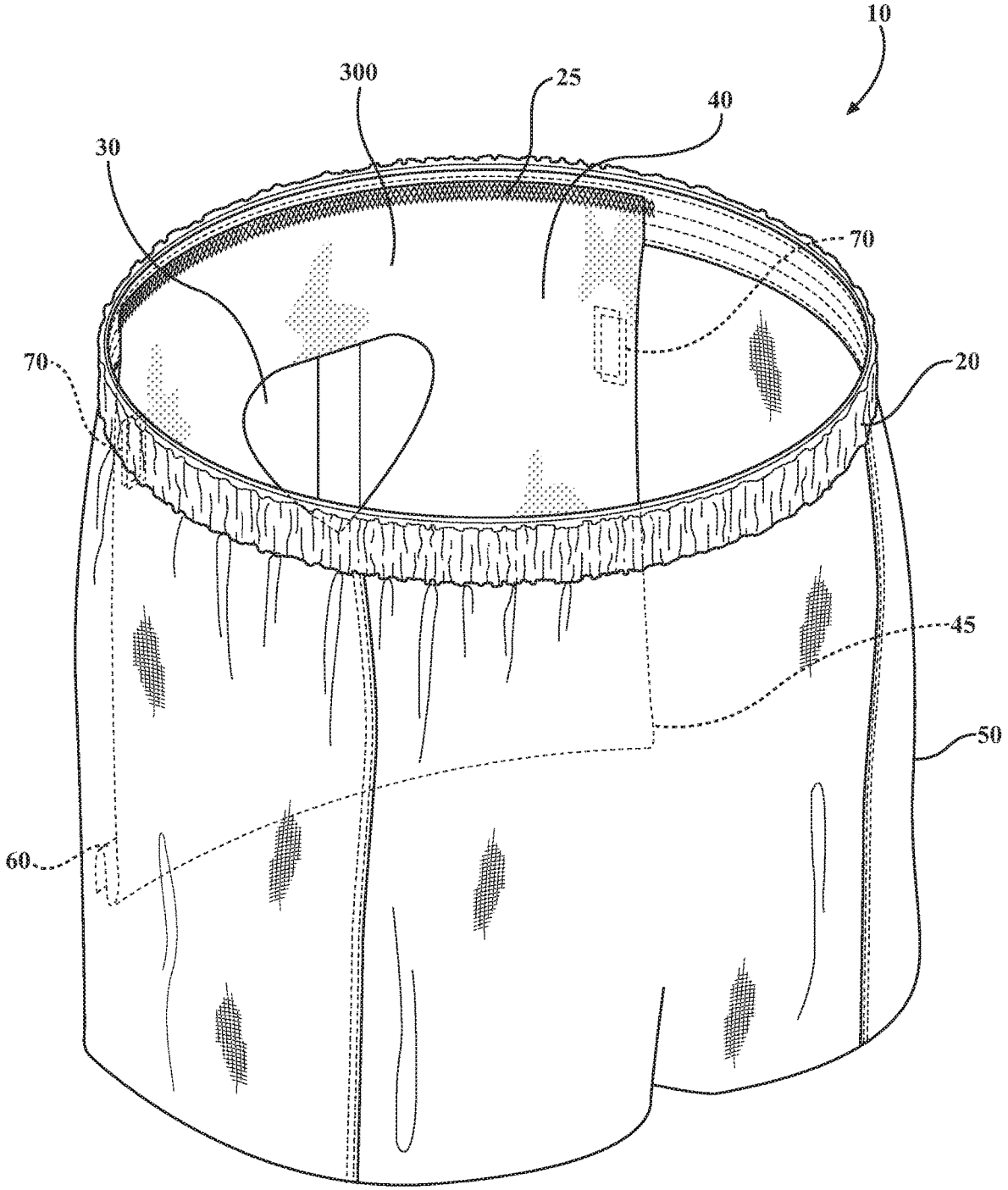
FIG. 5 is a perspective view of another embodiment of an undergarment.

Referring now to FIGS. 4*a* and 4*b*, a portion of another embodiment of an undergarment is shown. The upper edge 25 of the undergarment is attached with a waistband 20. The lower edge 60 may not be attached with the shorts and may be left free hanging. The height of the genital opening 30 with respect to the waistband 20 may be adjusted using one or more attachment elements 70. In FIG. 5, the lower edge 60 is attached with the brief/short/boxer 50. In other words, neither the upper edge 25 nor lower edge 60 in this embodiment is removably attached. The genital partitioning panel 40 has a U-shaped loop 45 that is used for a vertical adjustment of distance "L" from 1-10 inches or any other suitable range depending on wearer's habit or physical dimensions. The undergarment 10 has one or more attachment elements/fasteners 70 on both edges 110 and 120 near the upper edge 25. These fasteners 70 may be used for adjusting distance "L". Fastener 70 may be selected from the group of adjustable straps, hooks, buttons, loop, snaps, zipper, or other means. These multiple fasteners may be used by any embodiment of the underwear for adjusting distance "L" and/or removably attaching genital partitioning panel.

In alternative embodiments of FIGS. 4*a* and 4*b*, the waistband 20 and the attached genital partitioning panel 40 may be worn by the user independent of the brief/short/boxer. The user may wear a brief, short, boxer, pant or other garment on top these embodiments. The lower edge 60 in these embodiments may either be free hanging or removably attached with the brief, short, boxer, pant or other garment. The lower edge may be removable attached using one or more attachment elements or fasteners discussed above.

As will be clear to those of skill in the art, the herein described and illustrated embodiments of the present invention may be altered in various ways without departing from the scope or teaching of the present invention. The foregoing detailed description has been presented for purposes of illustration and description. It is not intended to be exhaustive or to limit embodiments to the precise form disclosed. Many modifications and variations are possible in light of the above teaching. The described embodiments were chosen in order to explain principles and practical applications, to thereby enable others skilled in the art to best utilize various embodiments and with various modifications as are suited to the particular use contemplated. Thus, it is intended that the present invention covers the modifications and variations of this invention provided they come within the scope of the appended claims and their equivalents. As such, this disclosure should be interpreted broadly.

The invention claimed is:

1. An undergarment for a man, comprising:

a pair of boxer shorts having a waistband forming part of the shorts, the waistband having a front part to be disposed on a front of a waist of a man, the boxer short further having a pants portion interconnected with the waistband and extending downwardly therefrom, the pants portion defining a pair of leg openings and a crotch region therebetween;

the pants portion having a front section to be disposed on the front of the torso and legs of the man wearing the shorts and an opposed rear section to be disposed on the buttocks and rear of the legs of the man wearing the shorts, the front and rear sections being interconneted by the crotch region and a pair of opposed side sections, the front section having an inner surface and an opposing outer surface;

a genital partitioning panel having an upper edge and an opposed lower edge separated by a panel height, the genital partitioning panel further having a pair of side edges extending between the upper and lower edges, the pair of side edges being separated by a panel width, the genital partitioning panel being interconnected with the shorts at the upper edge of the genital partitioning panel, the genital partitioning panel having a genital opening defined therethrough, the opening being positioned such that when the waistband is disposed on the waist of a man, the genitals may be positioned through the opening and the genital partitioning panel defines a partition between the genitals and the legs or groin of the man; and a plurality of vertically spaced apart attachment elements disposed on the genital partitioning panel near the side edges toward the upper edge and at least two attachment elements disposed horizontally spaced apart on the inner surface of the shorts towards the waistband, the at least two attachment elements on the shorts and the corresponding attachment elements of both side edges on the genital partitioning panel securing the genital partitioning panel to the inner surface of the shorts to selectively adjust a distance between the genital opening and the waistband; or at least two attachment elements, one of the at least two attachment elements disposed near each side edge towards the upper edge on the genital partitioning panel and a plurality of vertically spaced apart attachment elements disposed on the inner surface of the shorts towards the waistband for the corresponding at least two attachment elements disposed near each side edge, the at least two attachment elements disposed near each side edge and the corresponding attachment elements disposed on the shorts securing the genital partitioning panel to the inner surface of the shorts to selectively adjust the distance between the genital opening and the waistband.

2. An undergarment in accordance with claim 1, wherein the upper edge of the genital partitioning panel is fixedly connected to the waistband/shorts.

3. An undergarment in accordance with claim 1, wherein the attachment elements are selected from the group consisting of adjustable straps, hooks, buttons, loop, snaps and zipper.

4. An undergarment in accordance with claim 1, wherein the lower edge of the genital partitioning panel is fixedly connected to the shorts.

5. An undergarment in accordance with claim 1, wherein the genital partitioning panel being interconnected with the boxer shorts only at limited areas of the lower edge, the panel generally freely hanging downwardly from the upper edge of the panel, the panel not extending past the crotch region or to the rear section of the pants portion.

6. An undergarment in accordance with claim 5, wherein the genital partitioning panel having a U-shaped loop towards the lower edge that is used for adjusting the distance between the genital opening and the waistband.

7. An undergarment in accordance with claim 5, wherein the genital partitioning panel is fixedly interconnected with the boxer shorts at the lower edge.

8. An undergarment in accordance with claim 5, wherein the genital partitioning panel is removably interconnected with the boxer shorts only at limited areas of the lower edge with straps, hooks, buttons, loops, snaps or zipper.

9. An undergarment in accordance with claim 1, wherein the upper edge and the lower edge is separated by the panel height of 1 inch to 20 inches.

10. An undergarment in accordance with claim 1, wherein the pair of side edges being separated by the panel width of 1 inch to 20 inches.

11. An undergarment in accordance with claim 1, wherein the attachment elements allow adjusting the distance of 1 inch to 12 inches between the genital opening and the waistband.

12. An undergarment in accordance with claim 1, wherein the distance between the genital opening and the waistband is adjusted in increments of ½ inch, 1 inch, 1½ inches or 2 inches.

13. An undergarment in accordance with claim 1, further comprising a zipper interconnecting the upper edge of the genital partitioning panel with the shorts, the zipper comprising a portion of a zipper on the upper edge of the genital partitioning panel and a corresponding portion of a zipper on the shorts, the zipper portions extending along all of the upper edge.

14. An undergarment in accordance with claim 1, wherein:

the plurality of vertically spaced apart attachment elements comprise button holes disposed on the genital partitioning panel near the side edges and the at least two attachment elements comprise buttons disposed horizontally spaced apart on the inner surface; or the at least two attachment elements comprise buttons disposed near each side edge towards the upper edge on the genital partitioning panel and the plurality of vertically spaced apart attachment elements comprise button holes disposed on the inner surface of the shorts.

15. An undergarment in accordance with claim 1, wherein:

the attachment elements are selected from the group consisting of hook-and-eye type fastener and snap buttons, the snap buttons comprising studs and sockets;

the plurality of vertically spaced apart attachment elements comprise hooks/studs disposed on the genital partitioning panel near the side edges and the at least two attachment elements comprise eyes/sockets disposed horizontally spaced apart on the inner surface; or the at least two attachment elements comprise eyes/sockets disposed near each side edge towards the upper edge on the genital partitioning panel and the plurality of vertically spaced apart attachment elements comprise hooks/studs disposed on the inner surface of the shorts.

16. An undergarment in accordance with claim 1, wherein:

the downwardly extending pants portion is a brief-style pants portion or a tight-boxer-style pants portion.

17. An undergarment in accordance with claim 1, wherein:

the genital opening has a bottom end that is U-shaped or V-shaped.

18. An undergarment in accordance with claim 1, wherein:

the genital opening is generally heart shaped.

19. An undergarment in accordance with claim 1, further comprising an additional panel covering the genital partitioning panel to cover the genitals positioned through the genital opening.

20. An undergarment in accordance with claim 19, wherein the additional panel and/or the genital partitioning panel has a generally rectangular shape.

* * * * *